US009427622B2

(12) United States Patent
Thrasher-Rudd et al.

(10) Patent No.: US 9,427,622 B2
(45) Date of Patent: Aug. 30, 2016

(54) RESISTANCE TRAINING DEVICE AND METHOD

(75) Inventors: Christie Thrasher-Rudd, Indianapolis, IN (US); William Alex Mecker, Milwaukee, WI (US)

(73) Assignees: Christie Thrasher-Rudd, Indianapolis, IN (US); Catherine C. Mecker, Indianapolis, IN (US)

( * ) Notice: Subject to any disclaimer, the term of this patent is extended or adjusted under 35 U.S.C. 154(b) by 200 days.

(21) Appl. No.: 13/337,383

(22) Filed: Dec. 27, 2011

(65) Prior Publication Data

US 2013/0165301 A1 Jun. 27, 2013

(51) Int. Cl.

| | |
|---|---|
| ***A63B 21/02*** | (2006.01) |
| ***A63B 21/04*** | (2006.01) |
| ***A63B 23/035*** | (2006.01) |
| ***A63B 7/00*** | (2006.01) |
| ***A63B 21/055*** | (2006.01) |
| ***A63B 21/00*** | (2006.01) |
| *A63B 21/16* | (2006.01) |
| *A63B 23/02* | (2006.01) |

(52) U.S. Cl.

CPC ..... *A63B 23/03541* (2013.01); *A63B 7/00* (2013.01); *A63B 21/00061* (2013.01); *A63B 21/0442* (2013.01); *A63B 21/0552* (2013.01); *A63B 21/4035* (2015.10); *A63B 23/0355* (2013.01); *A63B 23/03575* (2013.01); *A63B 21/16* (2013.01); *A63B 23/0205* (2013.01); *A63B 23/03525* (2013.01)

(58) Field of Classification Search

CPC .. A63B 21/04; A63B 21/0421; A63B 21/05; A63B 21/0552; A63B 23/0355; A63B 21/055; A63B 21/0555; A63B 21/557; A63B 21/02

USPC ..... 482/92, 121, 122, 126, 129, 131, 482/142–144

See application file for complete search history.

(56) References Cited

U.S. PATENT DOCUMENTS

| | | | | |
|---|---|---|---|---|
| 562,389 | A * | 6/1896 | Gossweiler | 482/129 |
| 735,065 | A | 8/1903 | Chellis et al. | |
| 1,965,511 | A | 7/1934 | Preston | |
| 4,685,671 | A * | 8/1987 | Hagerman et al. | 482/124 |
| 4,909,505 | A | 3/1990 | Tee | |
| 5,024,433 | A | 6/1991 | Mosberg | |
| 5,352,174 | A | 10/1994 | Mason et al. | |
| 5,571,064 | A | 11/1996 | Holm | |
| 5,885,190 | A | 3/1999 | Reiter | |
| 5,997,448 | A | 12/1999 | Duba | |
| 6,322,483 | B1 * | 11/2001 | Rotella | 482/129 |
| 6,338,700 | B1 | 1/2002 | Pollock | |
| 6,450,929 | B1 | 9/2002 | Markham | |
| 6,497,641 | B1 | 12/2002 | Hinds | |

(Continued)

FOREIGN PATENT DOCUMENTS

| | | | |
|---|---|---|---|
| EP | 2520342 | A1 * | 11/2012 |
| WO | WO 2011081564 | A1 * | 7/2011 |

*Primary Examiner* — Oren Ginsberg
*Assistant Examiner* — Nyca T Nguyen
(74) *Attorney, Agent, or Firm* — Ice Miller LLP

(57) ABSTRACT

A resistance-based physical training device and method are disclosed. The device includes an inelastic support strap located above a user and an elastic resistance strap coupled to the support strap. The method involves pulling the resistance strap, which resists or opposes the pulling movement to provide a unique, fun, effective, efficient, and total-body workout.

17 Claims, 8 Drawing Sheets

(56) References Cited

U.S. PATENT DOCUMENTS

| | | | | |
|---|---|---|---|---|
| 6,662,651 | B1 * | 12/2003 | Roth | 73/379.02 |
| 6,726,606 | B2 * | 4/2004 | Jacobsen | 482/121 |
| 6,908,418 | B2 | 6/2005 | Sauré | |
| 6,923,750 | B1 | 8/2005 | Hinds | |
| 7,044,896 | B2 | 5/2006 | Hetrick | |
| 7,077,793 | B2 | 7/2006 | Wu | |
| 7,090,622 | B2 | 8/2006 | Hetrick | |
| 7,651,448 | B2 | 1/2010 | Hetrick | |
| 7,762,932 | B2 | 7/2010 | Hetrick | |
| 7,785,244 | B2 | 8/2010 | Hetrick | |
| 7,806,814 | B2 | 10/2010 | Hetrick | |
| 7,811,202 | B2 | 10/2010 | Planke | |
| 8,007,413 | B1 | 8/2011 | Wu | |
| 8,152,704 | B2 * | 4/2012 | Brice et al. | 482/129 |
| 2001/0034291 | A1 | 10/2001 | Horton | |
| 2002/0022555 | A1 | 2/2002 | Nesci | |
| 2003/0158024 | A1 * | 8/2003 | Saure | 482/126 |
| 2010/0004104 | A1 * | 1/2010 | Gustafson | 482/132 |
| 2010/0267531 | A1 | 10/2010 | Hetrick | |
| 2010/0292056 | A1 | 11/2010 | Birch et al. | |
| 2010/0298106 | A1 * | 11/2010 | Bowser | 482/148 |
| 2011/0059829 | A1 | 3/2011 | Hetrick | |
| 2011/0166003 | A1 | 7/2011 | Brice et al. | |
| 2011/0319230 | A1 * | 12/2011 | Brendle | 482/37 |
| 2012/0277074 | A1 * | 11/2012 | Zeldakov | 482/126 |

* cited by examiner

RESISTANCE TRAINING DEVICE AND METHOD

FIELD OF THE DISCLOSURE

The present disclosure relates to a physical training device and method. More particularly, the present disclosure relates to a resistance-based physical training device and method.

BACKGROUND OF THE DISCLOSURE

Some exercises are performed without the use of supplemental equipment. For example, a person may perform sit-ups or crunches to strengthen his or her abdominal muscles without the use of supplemental equipment. However, sit-ups and crunches may only work a limited region of the abdominal muscles. As another example, a person may walk, jog, or run without the use of specialized equipment.

Other exercises may be performed with supplemental equipment. The supplemental equipment may be designed to enhance the workout and/or to make the workout more comfortable. One such piece of supplemental equipment is the TRX® suspension training device available from Fitness Anywhere, LLC of San Francisco, Calif. The TRX® device is inelastic and requires the user to suspend his or her body weight, such as by as leaning or hanging from the device. However, these movements may put unwanted pressure on the user's joints and make the user unstable.

SUMMARY

The present disclosure provides a resistance-based physical training device and method. The device includes an inelastic support strap located above a user and an elastic resistance strap coupled to the support strap. The method involves pulling the resistance strap, which resists or opposes the pulling movement to provide a unique, fun, effective, efficient, and total-body workout.

According to an embodiment of the present disclosure, a physical training device is disclosed, the device being coupled to a support located above a user. The device has a top end located near the support and a bottom end located near the user. The device includes an inelastic support strap located near the top end of the device, the support strap hanging vertically downward from the support, and an elastic resistance strap coupled to the support strap, the resistance strap having a first end with a first handle, a second end with a second handle, and a middle portion between the first and second ends.

According to another embodiment of the present disclosure, a physical training device is disclosed. The device includes an elastic resistance strap having a first end, a second end, and a middle portion between the first and second ends, a first handle coupled to the first end of the resistance strap, and a second handle coupled to the second end of the resistance strap, each of the first and second handles including an inner loop that is configured to receive the user's hand and an outer loop around the inner loop that is configured to receive the user's foot, the inner loop being distinct from the outer loop.

According to yet another embodiment of the present disclosure, a method is disclosed for use with a physical training device, the device including an inelastic support strap and an elastic resistance strap having first and second handles. The method includes the steps of: coupling the elastic resistance strap to the inelastic support strap, the inelastic support strap having a top end coupled to a support located overhead and a bottom end hanging freely beneath the support; and pulling the first and second handles of the elastic resistance strap.

BRIEF DESCRIPTION OF THE DRAWINGS

The above-mentioned and other features and advantages of this disclosure, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

A physical training device 10 is provided that hangs vertically downward from a horizontal support toward a user 100. Device 10 includes a first or top end 11 located near the horizontal support and a second or bottom end 12 located near user 100.

Figure 1:
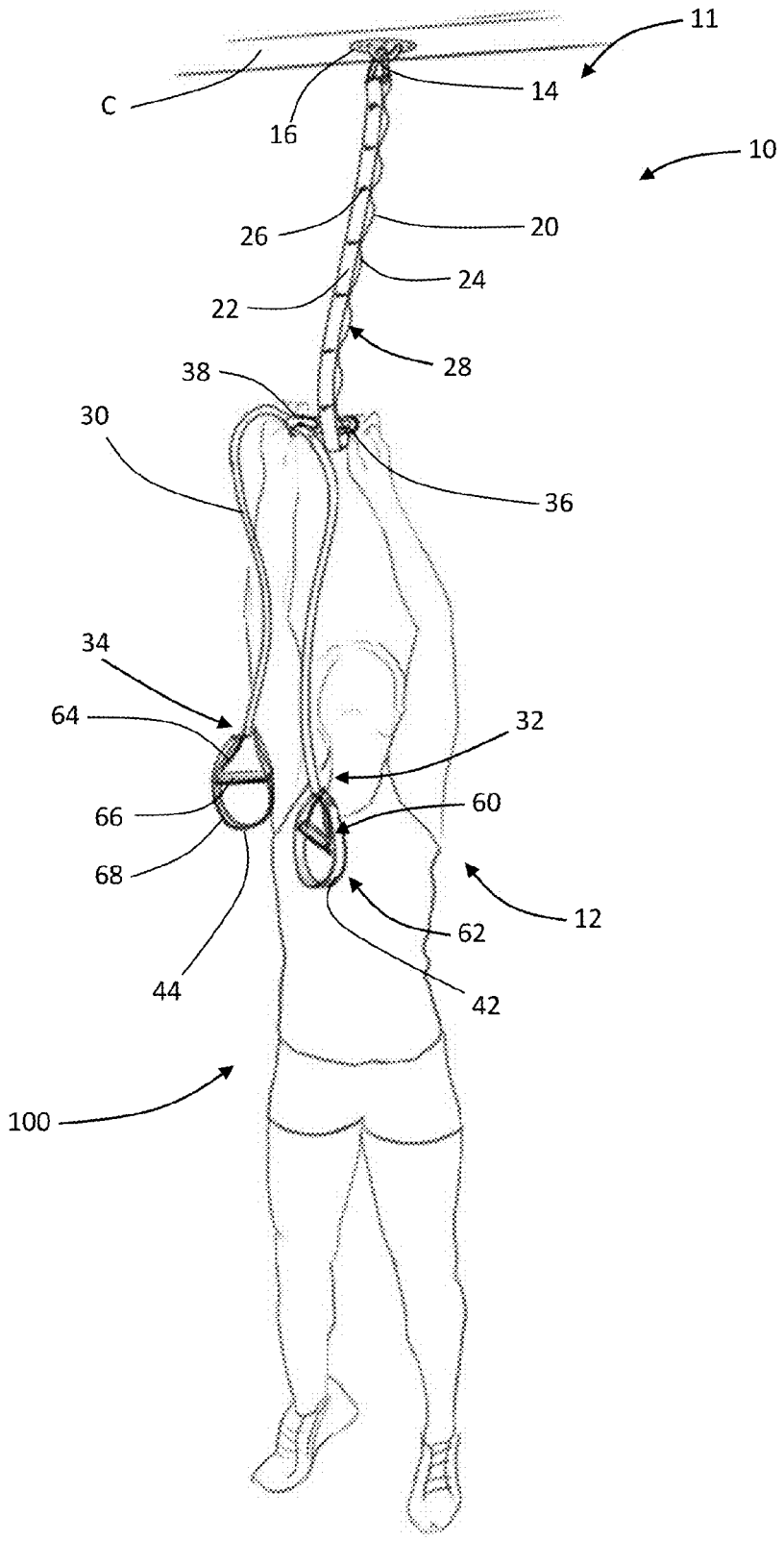
FIG. 1 is a front perspective view of an exemplary physical training device shown hanging from a ceiling, the device including a support strap and a resistance strap with handles.
Figure 2:
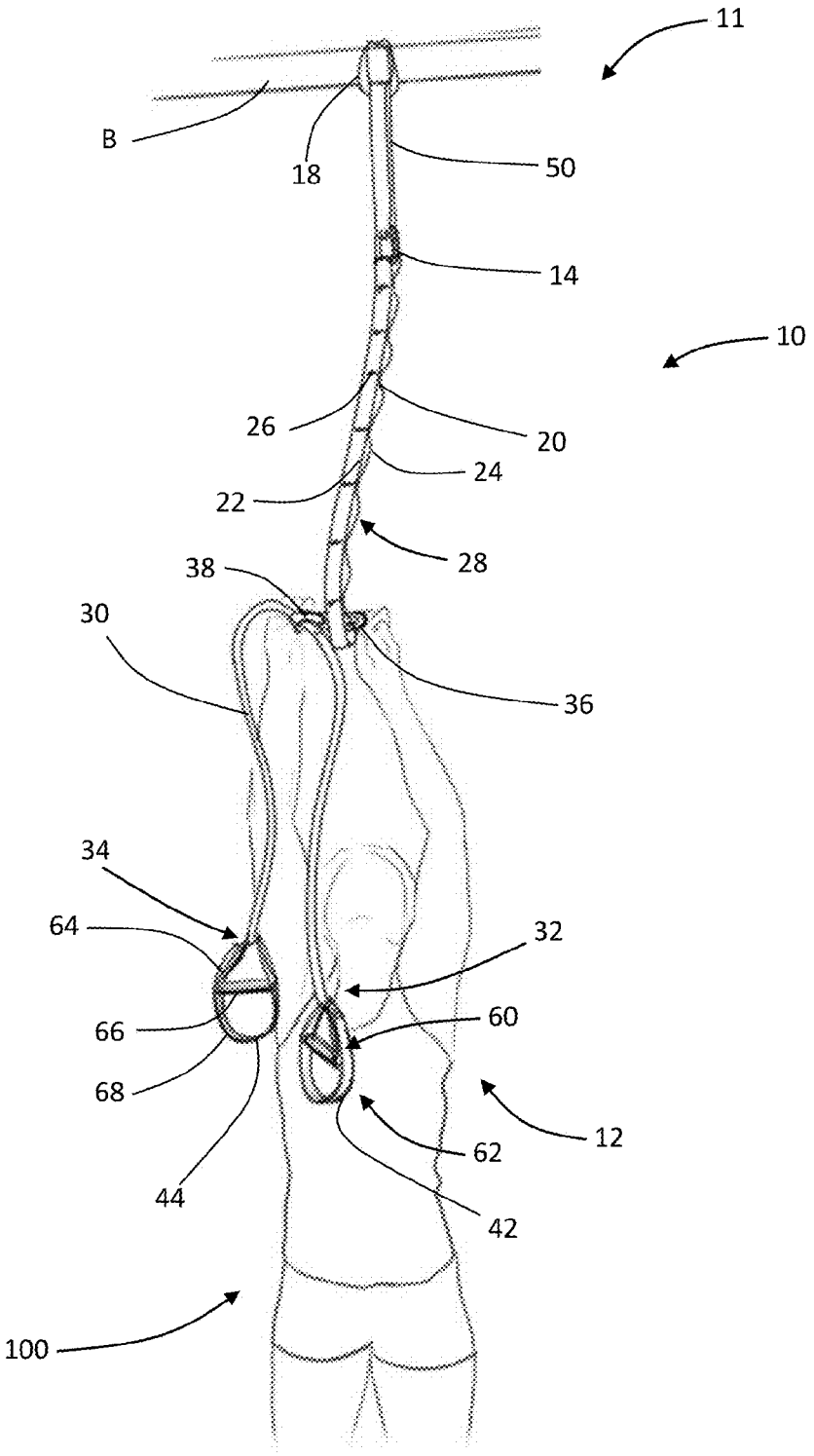
FIG. 2 is a front perspective view of the device of FIG. 1 shown hanging from a beam, the device further including an extension strap above the support strap.

Top end 11 of device 10 is coupled to the horizontal support at a location above user 100. In one embodiment, the horizontal support is a ceiling C or another overhead surface, as shown in FIG. 1. In this embodiment of FIG. 1, device 10 includes hook 14, illustratively a carabiner, that hooks securely but removably into mount 16 on ceiling C. In another embodiment, the horizontal support is a beam B or another overhead structure, as shown in FIG. 2. In this embodiment of FIG. 2, device includes loop 18 that wraps around beam B. For flexibility of usage, device 10 may include both hook 14 and the removable loop 18, as shown in FIG. 2.

According to an exemplary embodiment of the present disclosure, user 100 has full freedom of movement beneath the horizontal support (e.g., beam B, ceiling C). Rather than having to mount device 10 into a door frame or onto a door knob, for example, where the vertical door jamb and the door may obstruct movement, device 10 may be mounted to a horizontal support (e.g., beam B, ceiling C) that lacks underlying obstructions. Specifically, device 10 may lack obstructions within a cylindrical region that spans vertically from the horizontal support to the ground, the device 10 defining the longitudinal axis of the cylindrical region, and the cylindrical region having an obstruction-free radius of at least 20 inches, 30 inches, 40 inches, 50 inches, or more, from the longitudinal axis. If device 10 were to be hung in a standard door frame, the obstruction-free radius around device 10 may be less than 20 inches, such as about 12 inches or 18 inches, for example.

Top end 11 of device 10 includes a first, flexible, inelastic support strap 20 coupled to hook 14. Support strap 20 is shown further in FIGS. 3A-3C. Support strap 20 may be constructed of two adjacent strips 22, 24, of flexible, inelastic material, such as nylon webbing. The inelastic material of support strap 20 should maintain a substantially fixed length when pulled by user 100. An exemplary support strap 20 is about 25 inches to about 35 inches in length $L_S$, and more specifically about 30 inches in length $L_S$, for example. However, the length $L_S$ of support strap 20 may vary depending on the height of the horizontal support (e.g., beam B, ceiling C) above user 100. An exemplary support strap 20 is about 1 inch to about 3 inches in width $W_S$, and more specifically about 1.5 inches in width $W_S$.

Figure 3A:
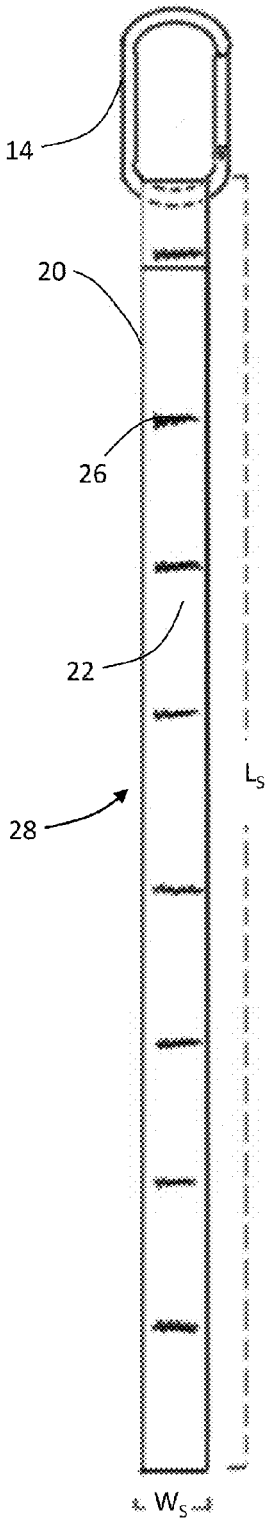
FIG. 3A is a front or rear elevational view of the support strap of FIG. 1.
Figure 3B:
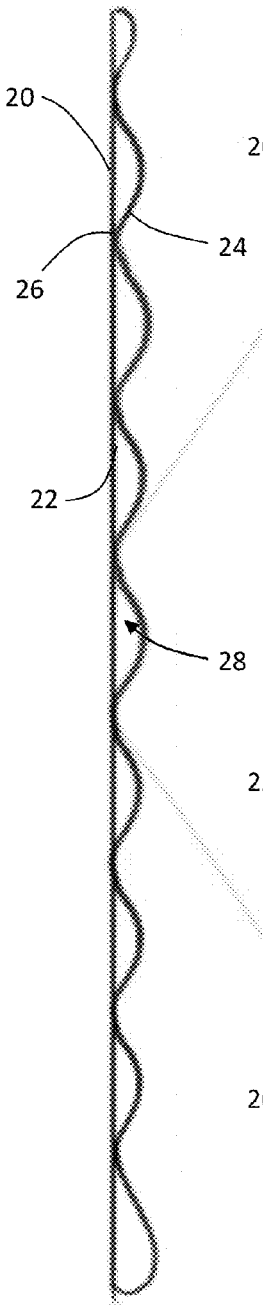
FIG. 3B is a side elevational view of the support strap of FIG. 3A.
Figure 4:
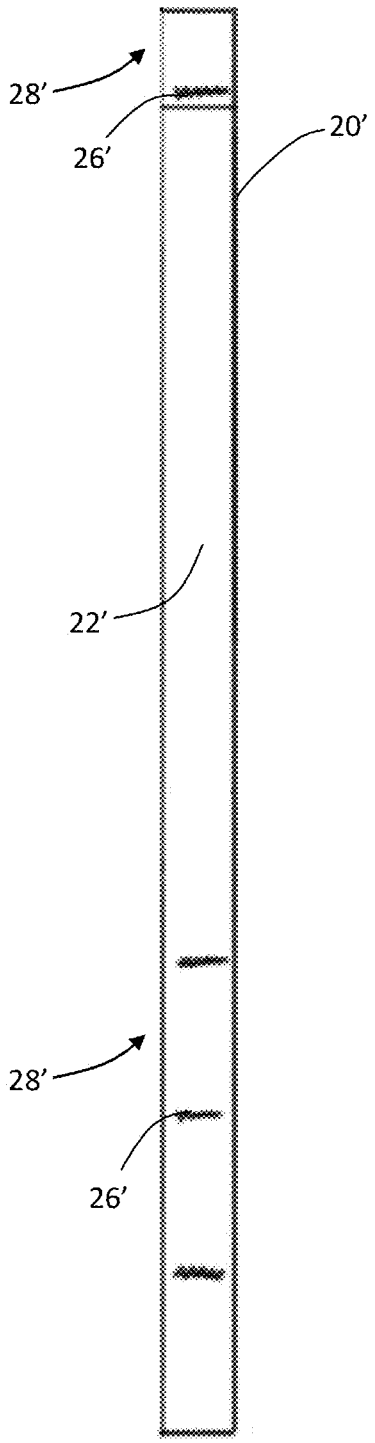
FIG. 4 is a front or rear elevational view of another support strap.

Strips 22, 24, of support strap 20 are sewn together at spaced-apart seams 26 to define a plurality of vertically-spaced loops 28 therebetween, as shown in FIGS. 3A and 3B. The illustrated support strap 20 includes nine vertically-spaced loops 28, although the number of loops 28 may vary. Also, the illustrated support strap 20 includes loops 28 spaced substantially evenly from end to end, although the location of and spacing between each loop 28 may vary. For example, in FIG. 4, another support strap 20' is shown with four loops 28', including one loop 28' at the top end of support strap 20', three loops 28' at the bottom end of support strap 20', and no loops in the middle of support strap 20'.

Figure 3C:
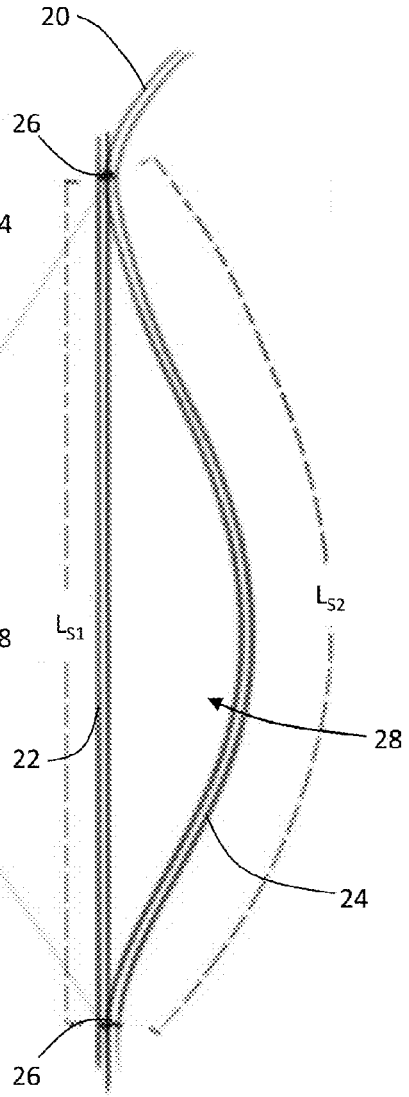
FIG. 3C is a partial side elevational view of the support strap of FIG. 3B.

Between adjacent seams 26, one strip of support strap 20 (e.g., strip 24) may be longer than the other strip of support strap 20 (e.g., strip 22), such that the longer strip 24 is forced outward, as shown in FIG. 3C. If the shorter strip 22 is about 3 inches in length $L_{S1}$, for example, the longer strip 24 may be about 3.5 inches in length $L_{S2}$, or more, making the longer strip 24 more than about 15% longer than the shorter strip 22. In use, the longer strip 24 is forced outward to make the corresponding loop 28 larger and more easily accessible.

Figures 5A, 5B, 5C:
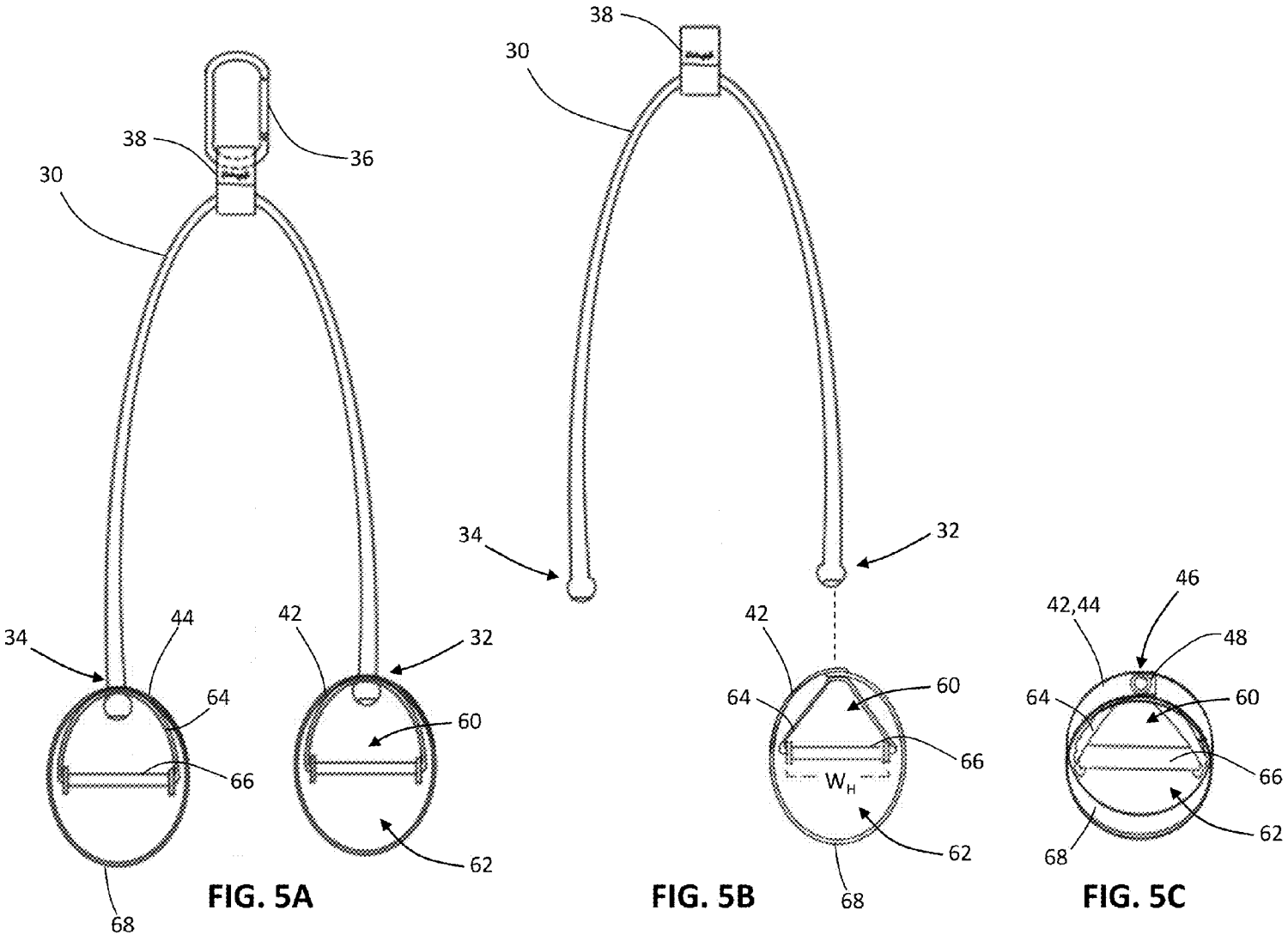
FIG. 5A is an assembled, front elevational view of the resistance strap and the handles of FIG. 1.
FIG. 5B is an exploded, front elevational view of the resistance strap and one of the handles of FIG. 5A.
FIG. 5C is a top perspective view of the handle of FIG. 5B.

Bottom end 12 of device 10 includes a second, flexible, elastic resistance strap 30 removably coupled to support strap 20. Resistance strap 30 is shown further in FIGS. 5A-5B and extends from left end 32 to right end 34. Resistance strap 30 may be constructed of rubber or another suitable elastomeric material that stretches by a noticeable amount (e.g., 1 inch, 3 inches, 5 inches, or more) when pulled by user 100 and returns to its original, natural state when released. Resistance strap 30 may be in the shape of round exercise tubing, as shown, or a flat band, for example. When at rest, an exemplary resistance strap 30 is about 40 inches to about 60 inches in total length, and more specifically about 50 inches in total length, for example. Thus, when resistance strap 30 is at rest and supported halfway between left end 32 and right end 34, as shown in FIG. 5A, resistance strap 30 may extend vertically downward from support strap 20 by about 25 inches to each end 32, 34. If support strap 20 is about 30 inches in length $L_S$ (FIG. 3A), for example, and each half or side of resistance strap 30 is about 25 inches in length (FIG. 5A), support strap 20 may contribute more length to device 10 than resistance strap 30. However, the length of resistance strap 30 may vary. It is also understood that one end of resistance strap 30 (e.g., left end 32) may be pulled further downward than the other end of resistance strap 30 (e.g., right end 34), and vice versa.

In the illustrated embodiment of FIG. 1, resistance strap 30 is removably coupled to support strap 20 via hook 36, illustratively another carabiner, and an intermediate strap 38. In one embodiment, intermediate strap 38 is constructed of a flexible, inelastic material, like the nylon webbing of support strap 20. In another embodiment, intermediate strap 38 is constructed of a rigid material, such as plastic or metal. Intermediate strap 38 may be integrally coupled, mechanically coupled, or otherwise coupled to hook 36. In use, hook 36 hooks securely into loop 28 of support strap 20, as shown in FIG. 1, and resistance strap 30 extends through intermediate strap 38, as shown in FIGS. 5A and 5B.

According to an exemplary embodiment of the present disclosure, user 100 may quickly and easily couple hook 36 into a desired loop 28 of support strap 20 to adjust the height of resistance strap 30 above the ground. Resistance strap 30 may be raised relative to support strap 20 and the ground by inserting hook 36 into a desired loop 28 located near top end 11 of device 10, and resistance strap 30 may be lowered relative to support strap 20 and the ground by inserting hook 36 into a desired loop 28 located near bottom end 12 of device 10. In one example, a tall user 100 may raise resistance strap 30 relative to support strap 20 and the ground, while a short user 100 may lower resistance strap 30 relative to support strap 20 and the ground. As another example, user 100 may raise resistance strap 30 relative to support strap 20 and the ground to increase resistance for one exercise (e.g., a standing exercise) and may lower resistance strap 30 relative to support strap 20 and the ground to decrease resistance for another exercise (e.g., a seated exercise).

Optionally, device 10 may further include one or more extension straps 50 to alter the length of device 10. In FIG. 2, extension strap 50 is located above support strap 20, but it is also within the scope of the present disclosure to locate extension strap 50 beneath support strap 20 (e.g., between support strap 20 and resistance strap 30). Without extension strap 50 in place, as shown in FIG. 1, device 10 is relatively short in overall length. On the other hand, with extension strap 50 in place, as shown in FIG. 2, device 10 is relatively long in overall length. In one example, a short user 100 may use extension strap 50 to lengthen device 10, while a tall user 100 may remove extension strap 50 to shorten device 10. As another example, user 100 may use extension strap 50 to reach a high ceiling beam B, but may avoid using extension strap 50 to reach a standard-height ceiling C. An exemplary extension strap 50 is capable of lengthening device 10 by about 10 inches to about 20 inches, and more specifically by about 15 to about 18 inches, for example. However, the size of extension strap 50 may vary depending on the height of the horizontal support (e.g., beam B, ceiling C) above user 100. Also, it is within the scope of the present disclosure to provide device 10 with a plurality of extension straps 50 of different sizes.

With resistance strap 30 at rest, ends 32, 34, of resistance strap 30 may come to rest near the head or shoulders of user 100, as shown in FIG. 1. For an adult user 100 that is about 5.5 feet tall, for example, device 10 may be adjusted to position ends 32, 34, of resistance strap 30 about 4.5 feet, 5 feet, or 5.5 feet from the ground. As discussed above, adjusting device 10 may involve selecting a different loop 28 of support strap 20 and/or using or excluding an extension strap 50, for example.

According to another exemplary embodiment of the present disclosure, a plurality of resistance straps 30 are provided, each resistance strap 30 having a different level of resistance. The level of resistance may be altered by varying the thickness of each resistance strap 30. The plurality of resistance straps 30 may include, for example, a thin-walled tube that supports less than 10 lbs. of maximum resistance, a medium-walled tube that supports more than 10 lbs. of maximum resistance, and a thick-walled tube that supports more than 20 lbs. of maximum resistance. In this manner, user 100 may select a resistance strap 30 having a desired level of resistance.

Device 10 further includes handles coupled to resistance strap 30. Specifically, device 10 includes a left handle 42 coupled to left end 32 of resistance strap 30 and a right handle 44 coupled to right end 34 of resistance strap 30, as shown in FIGS. 5A and 5B, where "left" and "right" are described and illustrated herein from the perspective of user 100. In the illustrated embodiment of FIG. 5C, each handle 42, 44, defines an aperture 46, which is optionally surrounded by a metal grommet 48, for receiving the corresponding end 32, 34, of resistance strap 30. Also, each end 32, 34, of resistance strap 30 may be enlarged or knotted, as shown in FIG. 5B, to prevent resistance strap 30 from slipping through each aperture 46.

Each handle 42, 44, includes a hand grip portion 60 and a foot grip portion 62. In the illustrated embodiment of FIGS. 5A-5C, hand grip portion 60 is defined by a first, inner loop 64 of material having a handle bar 66. Inner loop 64 may be constructed of a flexible, inelastic material, like the nylon webbing of support strap 20. Handle bar 66 may wrap around the material of inner loop 64 and may be constructed of plastic, metal, or another suitable material. It is also within the scope of the present disclosure that handle bar 66 may be padded for comfort and improved grip. Handle bar 66 should be sized to fit within the gripped hand of user 100. An exemplary handle bar 66 may be about 3 inches to about 6 inches in width $W_H$, and more specifically about 4.5 inches to about 5 inches in width $W_H$, such as about 4.75 inches in $W_H$. To accommodate handle bar 66, the perimeter of inner loop 64 may span about 12 inches to about 18 inches, and more specifically about 14 inches.

In the same illustrated embodiment of FIGS. 5A-5C, foot grip portion 62 is defined by a second, outer loop 68 of material that surrounds inner loop 64 and is distinct from inner loop 64. Outer loop 68 and inner loop 64 may be constructed of the same flexible, inelastic material, such as nylon webbing, and may be joined together using grommet 48 or another suitable fastener, as shown in FIG. 5C. Outer loop 68 should be sized to receive the foot of user 100. Thus, the perimeter of outer loop 68 may span about 20 inches to about 25 inches, and more specifically about 22 inches. Because inner loop 64 is distinct from outer loop 68, handle bar 66 on inner loop 64 (which is normally centered within outer loop 68) may shift upward and/or sideways to accommodate the foot of user 100 within outer loop 68. Unlike hand grip portion 60, foot grip portion 62 need not include a handle bar. Instead, the foot or shoe of user 100 may be placed directly against the material of outer loop 68.

Figure 6:
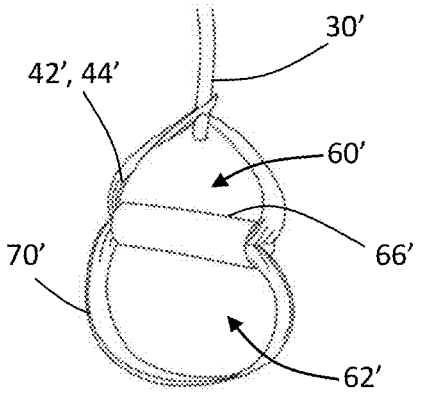
FIG. 6 is a front perspective view of another handle.

Another handle 42', 44', is shown in FIG. 6. Like handle 42, 44 (FIG. 5C), handle 42', 44' (FIG. 6) includes a hand grip portion 60' and a foot grip portion 62'. However, unlike handle 42, 44 (FIG. 5C), which includes distinct inner and outer loops 64, 68, handle 42', 44' (FIG. 6) includes a continuous loop 70' arranged in a "figure-8" shape. Handle bar 66' is centrally located on loop 70' along the intersection between hand grip portion 60' and a foot grip portion 62'.

Figure 7:
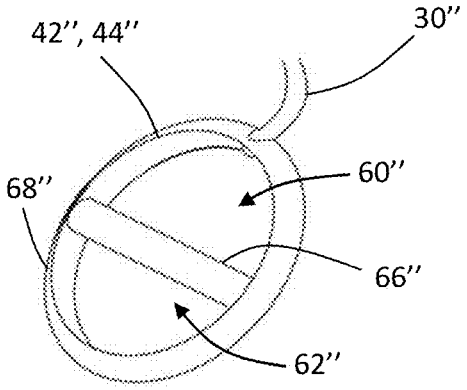
FIG. 7 is a front perspective view of yet another handle.

Yet another handle 42", 44", is shown in FIG. 7. Like handle 42, 44 (FIG. 5C), handle 42", 44" (FIG. 7) includes a hand grip portion 60" and a foot grip portion 62". However, unlike handle 42, 44 (FIG. 5C), which includes distinct inner and outer loops 64, 68, handle 42", 44" (FIG. 7) includes a single, outer loop 68". Handle bar 66" spans the entirety of outer loop 68" and is fixedly coupled to outer loop 68".

Figure 8A:
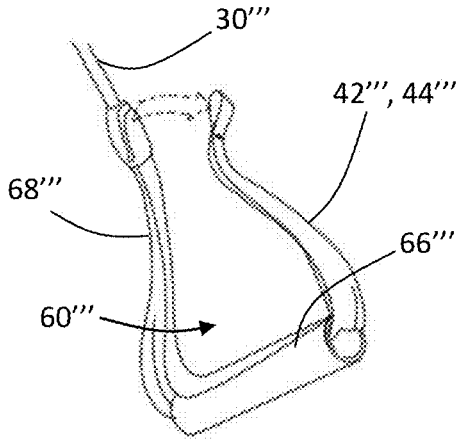
FIG. 8A is a front perspective view of still yet another handle shown in an open configuration.
Figure 8B:
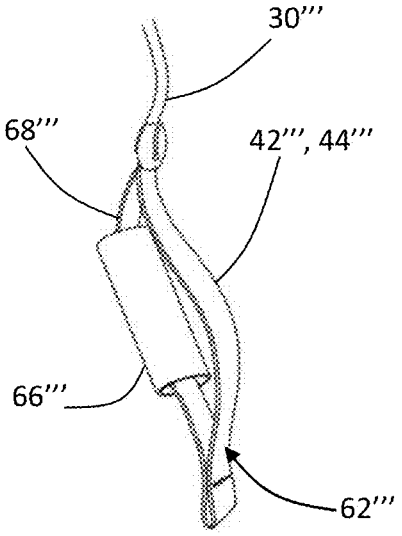
FIG. 8B is a front perspective view of the handle of FIG. 8A shown in a closed configuration.

Still yet another handle 42'", 44'", is shown in FIGS. 8A and 8B. Handle 42'", 44'", includes a single, outer loop 68'", that may be snapped open (FIG. 8A) and closed (FIG. 8B). Handle bar 66'" is slideably coupled to outer loop 68'" to define either hand grip portion 60'" (FIG. 8A) or foot grip portion 62'" (FIG. 8B). With handle bar 66'" positioned horizontally on outer loop 68'" (FIG. 8A), handle bar 66'" may receive a gripped hand. By contrast, with handle bar 66'" positioned vertically on outer loop 68'" (FIG. 8B), the now-exposed region of outer loop 68'" may receive a foot.

In operation, when resistance strap 30 is stretched by pulling downward on handles 42, 44, resistance strap 30 resists or opposes the pulling movement. The resistance from resistance strap 30 provides a unique, fun, effective, efficient, and total-body workout. The resistance from resistance strap 30 also enhances the workout. Over the same amount of time, user 100 may burn as many calories using device 10 as if he or she had run a long distance at a fast, 6-minute-mile pace. Thus, device 10 may have a larger metabolic impact than long-distance running Device 10 has been shown to boost the metabolism of user 100 for 1 day, 2 days, or more. Therefore, even if user 100 only works out with device 10 during 3 days or 4 days of a week, user 100 may maximize his or her metabolism over the entire week, for example.

Figures 9A, 9B:
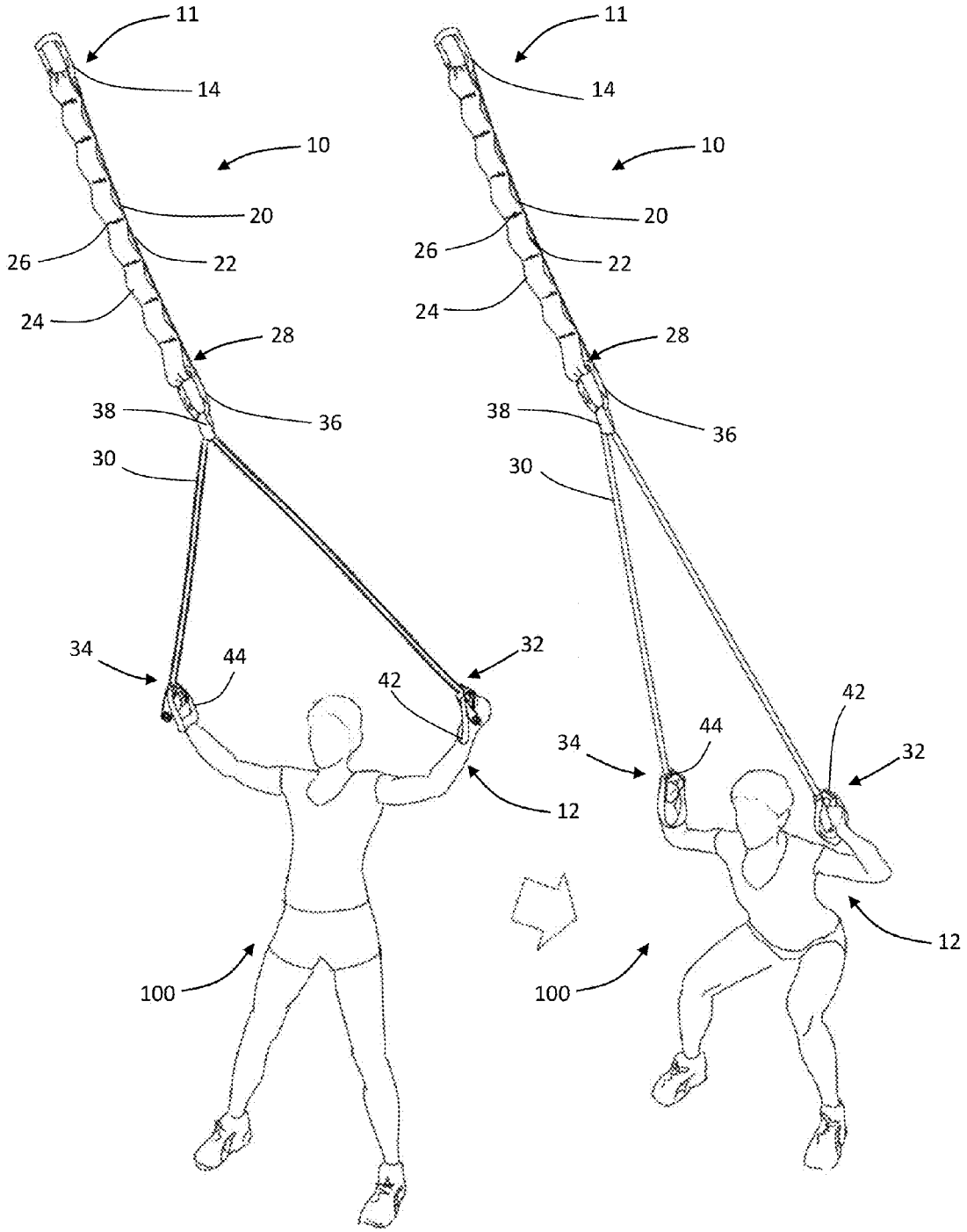
FIG. 9A is a front perspective view of the device of FIG. 1 in use, the user standing with his or her arms raised.
FIG. 9B is a front perspective view similar to FIG. 9A, the user squatting with his or her arms bent.

In FIGS. 9A and 9B, for example, user 100 bends his or her elbows and pulls downward on handles 42, 44, to stretch resistance strap 30, which works the muscles of the upper body (e.g., arms, shoulders). Additionally, user 100 bends his or her knees and squats downward to simultaneously work the muscles of the lower body (e.g., abdominal core, quad region). Compared to standard squats, device 10 enables user 100 to work more muscles in a shorter period of time.

Figure 10A:
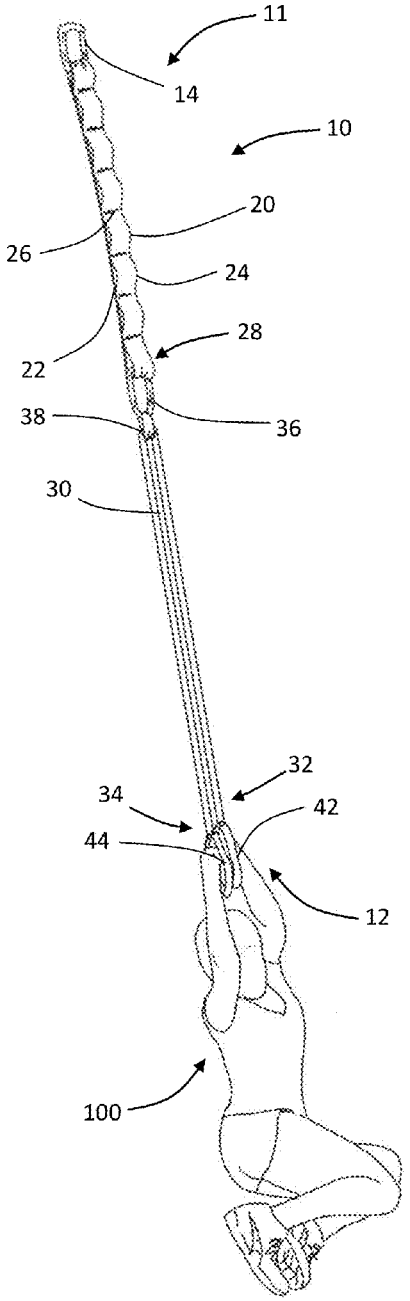
FIG. 10A is a front perspective view of the device of FIG. 1 in use, the user sitting with his or her arms raised.
Figure 10B:
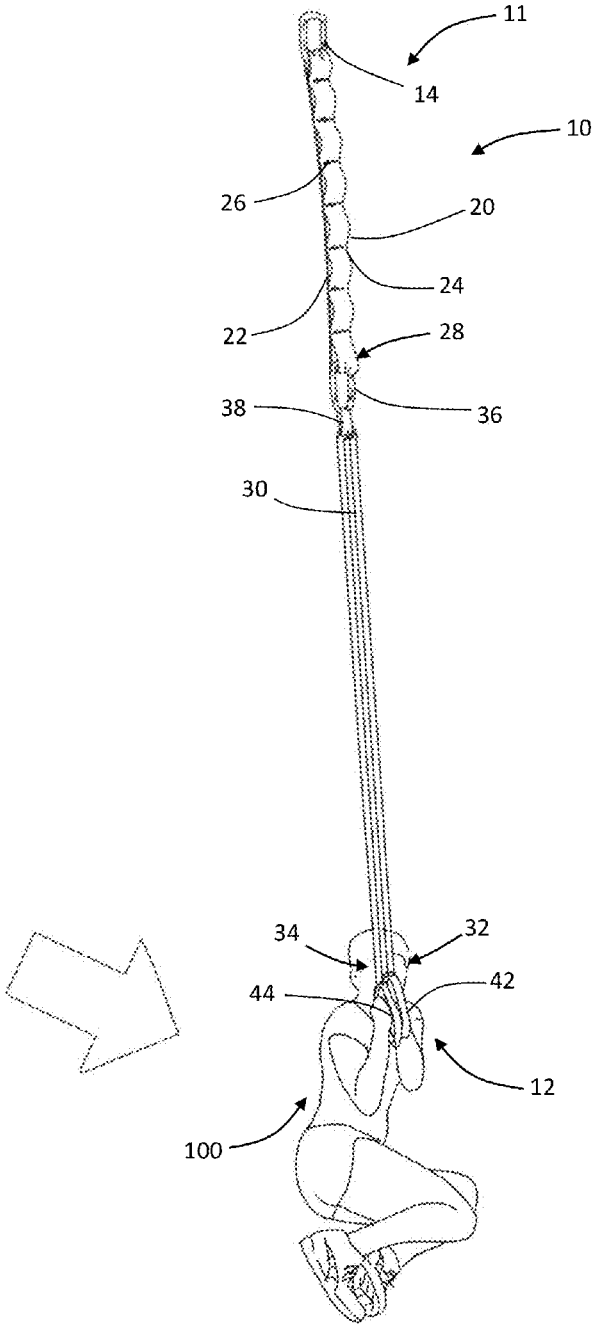
FIG. 10B is a front perspective view similar to FIG. 10A, the user crunching downward with his or her arms bent.

In FIGS. 10A and 10B, as another example, user 100 bends his or her elbows and pulls downward on handles 42, 44, from a seated position to stretch resistance strap 30 even further, which works the muscles of the upper body (e.g., arms, shoulders). Additionally, user 100 tightens his or her abdominal core muscles to simultaneously work the lower body. Compared to standard crunches, device 10 enables user 100 to work more muscles in a shorter period of time. Although standard crunches may work a limited region of the abdominal muscles, for example, device 10 may work the abdominal muscles, oblique muscles, pectoral muscles, and muscles near the ribs, hips, and lower back.

User 100 may perform a wide variety of exercises with device 10. For example, user 100 may perform anaerobic exercises with device 10 (e.g. leg lifts, squats, arm pulls) to gain strength, to build new lean tissue, and to improve flexibility. User 100 may also perform aerobic exercises with device 10 (e.g., jumping jacks, kicks, running in place) to improve cardiovascular health, to improve endurance, and to burn calories and fat. It is understood that these anaerobic and aerobic benefits may be realized by the same exercise motion. For example, an anaerobic, strength-building motion with device 10 may cause a muscle to break down, and then the body may aerobically burn calories and fat to repair the muscle.

Also, user 100 may grip device 10 in a variety of ways. For example, user 100 may hold the hand grip portions 60 of handles 42, 44, or user 100 may rest his or her feet against the foot grip portions 62 of handles 42, 44. Also, user 100 may hold handles 42, 44, apart in different hands (FIGS. 9A and 9B) or together in the same hand for double the resistance (FIGS. 10A and 10B).

Additionally, user 100 may position his or her body in a variety of ways when using device 10. For example, user 100 may manipulate device 10 from a standing position (FIG. 9A), a squatting position (FIG. 9B), a seated position (FIGS. 10A and 10B), while lying down (e.g., a plank position, a cycling position), or from another position. Providing user 100 with full freedom of movement beneath device 10, as shown, facilitates these different positions. For example, user 100 may be positioned behind device 10 (FIGS. 9A and 9B), in front of device 10, to the side of device 10 (FIG. 10A), or directly beneath device 10 (FIG. 10B) without interference from a vertical door jamb, a door, or another obstruction.

Also, user 100 may use device 10 in combination with other exercise equipment, such as gliders, body bars, weights, treadmills, and other equipment. For example, user 100 may lift arm weights while performing leg lifts with his or her foot in device 10.

Furthermore, user 100 may operate device 10 in a variety of settings. For example, user 100 may operate device 10 in a group class setting with a live instructor, optionally a certified instructor, and other class members. In this class setting, a plurality of devices 10 may be spaced apart and hung from the ceiling of a fitness center for simultaneous use by the instructor and the class members. As another example, user 100 may operate device 10 individually, such as at home. In this at-home setting, user 100 may follow along with a web-based instruction session or a recorded instruction video, for example.

Device 10 may accommodate a wide range of users 100. For example, as discussed above, the total length of device 10, the elevation of device 10 above the ground, and the resistance of device 10 may be customized to accommodate the abilities, limitations, and goals of each particular user 100.

Device 10 may be sold in a kit. The kit may include support strap 20, a plurality of resistance straps 30, optionally with pre-attached handles 42, 44, and a plurality of extension straps 50. The kit may also include written instructions for safely and properly assembling and using device 10. The kit may further include a recorded instruction video for at-home use, as discussed above.

While this invention has been described as having exemplary designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A physical training device coupled to a support located above a user, the device having a longitudinal axis, a top end located near the support, and a bottom end located near the user, the device comprising:

an inelastic support strap located near the top end of the device, the inelastic support strap hanging vertically downward from the support;

an intermediate strap extending vertically downward from the inelastic support strap, wherein the inelastic support strap defines a plurality of loops, each loop being sized to receive a hook that is coupled to the intermediate strap to attach the intermediate strap to the inelastic support strap;

an elastic resistance strap located near the bottom end of the device, the elastic resistance strap extending vertically downward from the intermediate strap, the elastic resistance strap having a first end with a first handle, a second end with a second handle, and a middle portion between the first and second ends; and wherein the device is configured to be in an obstruction-free region having a radius of at least 20 inches around the longitudinal axis of the device to provide the user with freedom of movement beneath the support, wherein the user can exercise in the obstruction-free region having the radius of at least 20 inches.

2. The device of claim 1, wherein:

the middle portion of the elastic resistance strap is coupled to the intermediate strap; and the first and second ends of the elastic resistance strap are configured to hang vertically downward from the intermediate strap toward the user.

3. The device of claim 2, wherein the inelastic support strap is longer than half of the elastic resistance strap, such that the inelastic support strap accounts for more length of the device than the elastic resistance strap.

4. The device of claim 3, wherein the elastic resistance strap is about 25 inches to about 35 inches in length.

5. The device of claim 1, wherein each of the first and second handles includes an inner loop that is configured to receive the user's hand and an outer loop surrounding the inner loop that is configured to receive the user's foot, the inner loop being distinct from the outer loop.

6. The device of claim 5, wherein each of the first and second handles further includes a handle bar coupled to the inner loop.

7. The device of claim 6, wherein the handle bar on each inner loop is configured to move relative to the corresponding outer loop.

8. The device of claim 6, wherein the handle bar on each inner loop is substantially centered in the corresponding outer loop.

9. The device of claim 5, wherein:

the inner and outer loops of the first handle cooperate to define a first aperture that receives the first end of the elastic resistance strap; and the inner and outer loops of the second handle cooperate to define a second aperture that receives the second end of the elastic resistance strap.

10. The device of claim 9, wherein the first and second ends of the elastic resistance strap are enlarged to prevent withdrawal of the first and second ends through the first and second apertures.

11. The device of claim 1, wherein an entire length of the inelastic support strap is configured to be located above the user when the user is in a standing position.

12. The device of claim 1, wherein at least a portion of the elastic resistance strap is configured to be located above the user when the user is in a standing position.

13. The device of claim 1, wherein the inelastic support strap includes a first strip of material attached to a second strip of material between the plurality of loops, the first and second strips of material cooperating to define the plurality of loops, the second strip of material being longer than the first strip of material such that the second strip of material is biased outward to define each loop.

14. The device of claim 1, further comprising an extension strap located between the support and the inelastic support strap to lower the first and second handles toward the user.

15. The device of claim 1, wherein the obstruction-free region is cylindrical in shape.

16. The device of claim 1, wherein the radius of the obstruction-free region is at least 40 inches.

17. The device of claim 1, wherein the obstruction-free region extends vertically from the support to the ground.

* * * * *